US008143878B2

(12) United States Patent
Kresse et al.

(10) Patent No.: US 8,143,878 B2
(45) Date of Patent: Mar. 27, 2012

(54) STARTER CIRCUIT, BANDGAP CIRCUIT AND MONITORING CIRCUIT

(75) Inventors: Julia Kresse, Munich (DE); Christoph Mayerl, Munich (DE); Christoph Saas, Munich (DE); Uwe Weder, Au / Hallertau (DE); Dennis Tischendorf, Unterhaching (DE)

(73) Assignee: Infineon Technologies AG, Neubiberg (DE)

( * ) Notice: Subject to any disclaimer, the term of this patent is extended or adjusted under 35 U.S.C. 154(b) by 602 days.

(21) Appl. No.: 12/334,204

(22) Filed: Dec. 12, 2008

(65) Prior Publication Data

US 2010/0148744 A1 Jun. 17, 2010

(51) Int. Cl.
*G05F 3/10* (2006.01)

(52) U.S. Cl. ..... 323/314; 323/901

(58) Field of Classification Search ..... 323/313, 323/314, 901, 304, 311, 312, 316; 327/539
See application file for complete search history.

(56) References Cited

U.S. PATENT DOCUMENTS 5,867,013 A * 2/1999 Yu ..... 323/314

* cited by examiner

*Primary Examiner* — Gary L Laxton
(74) *Attorney, Agent, or Firm* — Dickstein Shapiro LLP

(57) ABSTRACT

A bandgap circuit, a starter circuit, and a monitoring circuit for a bandgap circuit including a bandgap reference circuit having a first branch and a second branch, the first branch having a first node, the second branch having a second node, such that a potential at the first node is equal to a potential at the second node in an equilibrium of the bandgap reference circuit. The bandgap reference circuit further having a feedback node for a feedback signal and a feedback circuit coupled to the first and second nodes and adapted to provide a feedback signal to the feedback node based upon a comparison of the potentials at the first and second nodes.

23 Claims, 9 Drawing Sheets

STARTER CIRCUIT, BANDGAP CIRCUIT AND MONITORING CIRCUIT

BACKGROUND

In many circuits, a need for a fixed or determined voltage for internal or external purposes exists. Such a fixed or determined reference voltage may, for instance, be generated by a bandgap circuit based on an externally or internally provided supply voltage.

The presence of such a reference voltage may, for instance, represent a prerequisite for an operation of further circuits or parts of such a circuit. Hence, a controlled power-up reducing the probability of an improper initiation of the circuit providing such a reference voltage may be desirable for the operation of the whole circuit.

BRIEF DESCRIPTION OF THE DRAWINGS

Embodiments according to the present invention will be described hereinafter making reference to the appended drawings.

DETAILED DESCRIPTION OF THE INVENTION

Figure 1:
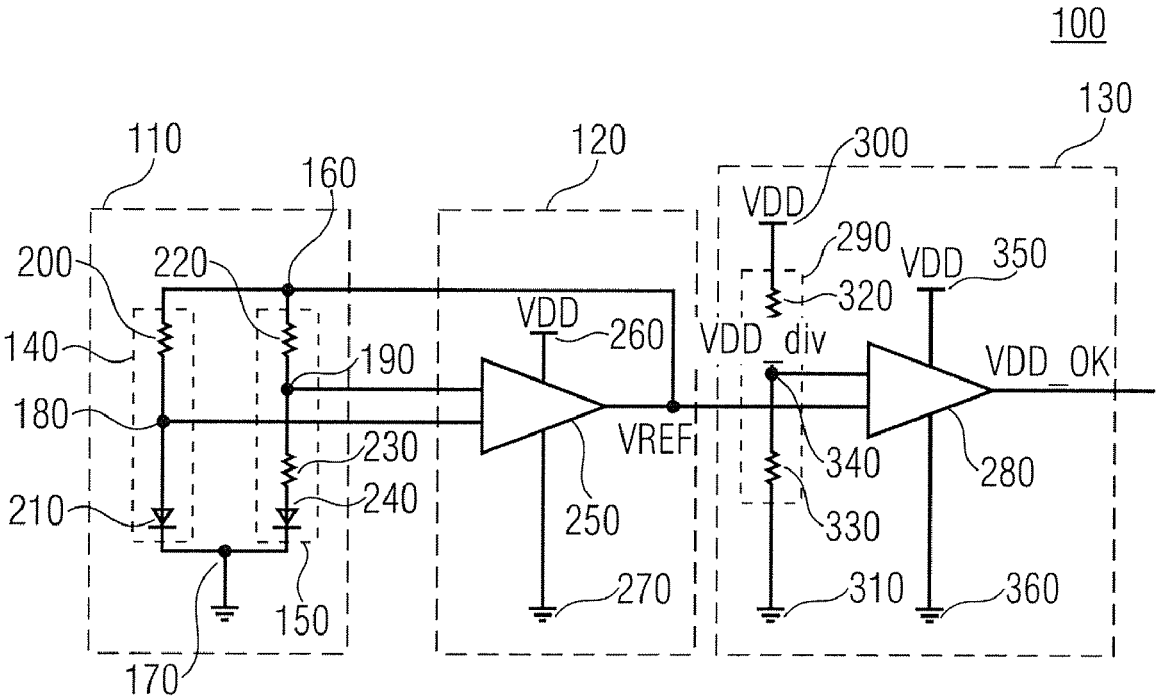
FIG. 1 shows a circuit diagram of a bandgap reference circuit including a surveillance circuit for monitoring a presence of a sufficient supply voltage.

In the following, embodiments according to the present invention will be described in more detail. First, with reference to FIGS. 1 and 2, a bandgap reference circuit along with its mode of operation will be described in more detail. Afterwards, with reference to FIGS. 3 and 4, three conditions to be monitored by embodiments according to the present invention will be outlined in more detail. Thereafter, with reference to FIGS. 5 to 11, embodiments according to the present invention in the form of a starter circuit, a bandgap circuit and a monitoring circuit along with implementational details will be outlined in more detail.

In the following, identical or similar elements, circuits and objects shall be referred to by identical or similar reference signs in the Figs. Moreover, elements, circuits and objects denoted by identical or similar reference signs may be implemented identically or similarly being not only structurally, but also concerning their physical, electrical and other properties similar or identical, unless noted otherwise. Therefore, unless noted otherwise, parts of the description, which refer to identical or similar elements, circuits and objects may be substituted by or supplemented with parts of the description, which refer to corresponding elements, circuits and objects elsewhere. Also, unless noted otherwise, elements, circuits and objects denoted by the same or similar reference signs may be identical or similar concerning the above-mentioned properties and features. This enables a clearer and yet concise description of embodiments according to the present invention.

Moreover, summarizing the reference signs may be used for elements, circuits and objects appearing more than once in an embodiment according to the present invention. Unless a specific property, a feature or another attribute of a specific element, circuit or object is considered, summarizing reference signs will be used to describe properties, features and other attributes of the respective elements, circuits and objects, also illustrating the above-mentioned possibility of implementing similar or identical elements, circuits and objects.

Concerning circuits and integrated circuits (IC), often an internal voltage domain is defined and generated by means of a voltage regulator. As a consequence, the internal voltage generated by such a voltage regulator follows a slowly increasing external (supply) voltage.

However, an activation of internal parts of the circuits is supposed to occur only when the internal voltage supply has reached a sufficient level to guarantee the correct functionality of the corresponding circuits. This determination or recognition of the (voltage) level should be accomplished independently of the development of the externally supplied voltage. This, however, may require the presence of a reliable reference voltage, an absolute value of which is known and (chip) internally available.

In existing circuits, a bandgap circuit may be used for generating a more or less temperature independent voltage as an absolute reference voltage VREF. Typically, the reference voltage may be 1.2 V, but may also be different, as will be mentioned below.

FIG. 1 shows a circuit diagram of a bandgap circuit 100 comprising a bandgap reference circuit 110, a feedback circuit 120 and a surveillance circuit 130. The bandgap reference circuit 110 comprises a first branch 140 and a second branch, which are coupled, in parallel, between a feedback node 160 and a terminal or a node for a reference potential, for instance, ground (GND). Each of the two branches 140, 150 further comprises a first node 180 and a second node 190, respectively, at which potentials are obtainable, which are equal when the bandgap reference circuit 110 is in an equilibrium or in an equilibrium state.

The first branch 140 comprises a series connection of a resistor 200 and a forward biased diode 210. The first node 180 is situated in-between the resistor 200 and the diode 210. In other words, based upon providing a positive voltage to the feedback node 160 compared to the reference potential present at the terminal for the reference potential 170, the first branch 140 comprises the transistor 200 being directly coupled to the feedback node 160. Via the first node 180, the resistor 200 is coupled to a cathode of the diode 210, the anode of which is connected to the terminal for the reference potential 170.

The second branch 150 also comprises a resistor 220 directly coupled with one terminal to the feedback node 160. A second terminal of the resistor 220 is coupled to the second node 190 and further to a further resistor 230 being connected in series with a forward biased diode 240. The series connection of the resistor 230 and the forward bias diode 240 are, hence, coupled in-between the second node 190 and the terminal for the reference potential 170. Accordingly, the diode 240 is coupled with a cathode to the terminal for the reference potential 170 and with an anode via the further resistor 230 to the second node 190 and the feedback node 160 via the resistor 220.

The feedback circuit 120 comprises a differential amplifier 250, which is coupled to both the first and the second nodes 180, 190. To be more precise, the first node 180 is coupled to a non-inverting input of the differential amplifier 250, while the second node 190 is connected to an inverting input of the differential amplifier 250. The differential amplifier 250 comprises an output, which is coupled to the feedback node 160 and at which the reference potential VREF is provided as a feedback signal to the bandgap reference circuit 110.

In more general terms, the differential amplifier 250 is adapted to provide the feedback signal based upon a comparison of the potentials present at the first and the second nodes 180, 190 of the bandgap reference circuit 110. The differential amplifier 250 provides, at its output in the circuit shown in FIG. 1 as the feedback signal, a signal having the voltage level VREF.

Naturally, the differential amplifier 250 furthermore comprises an input coupled to a terminal 260, a power supply voltage VDD and an input coupled to the terminal for the reference potential 270.

Figure 10:
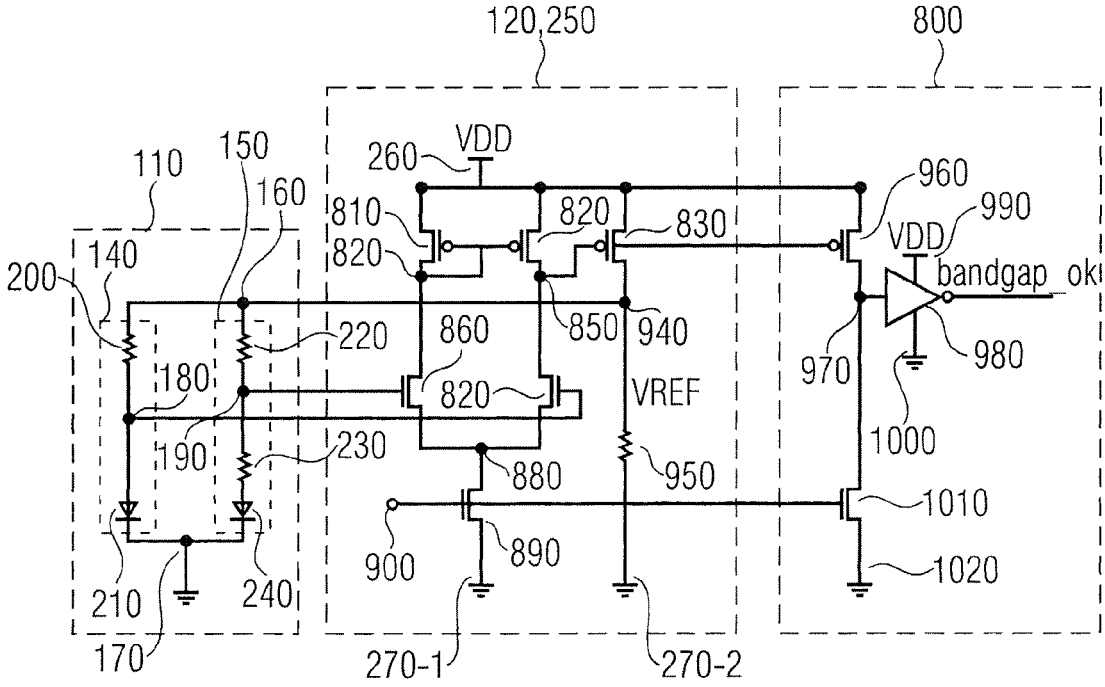
FIG. 10 shows a circuit diagram of a bandgap circuit according to an embodiment of the present invention.
Figure 11:
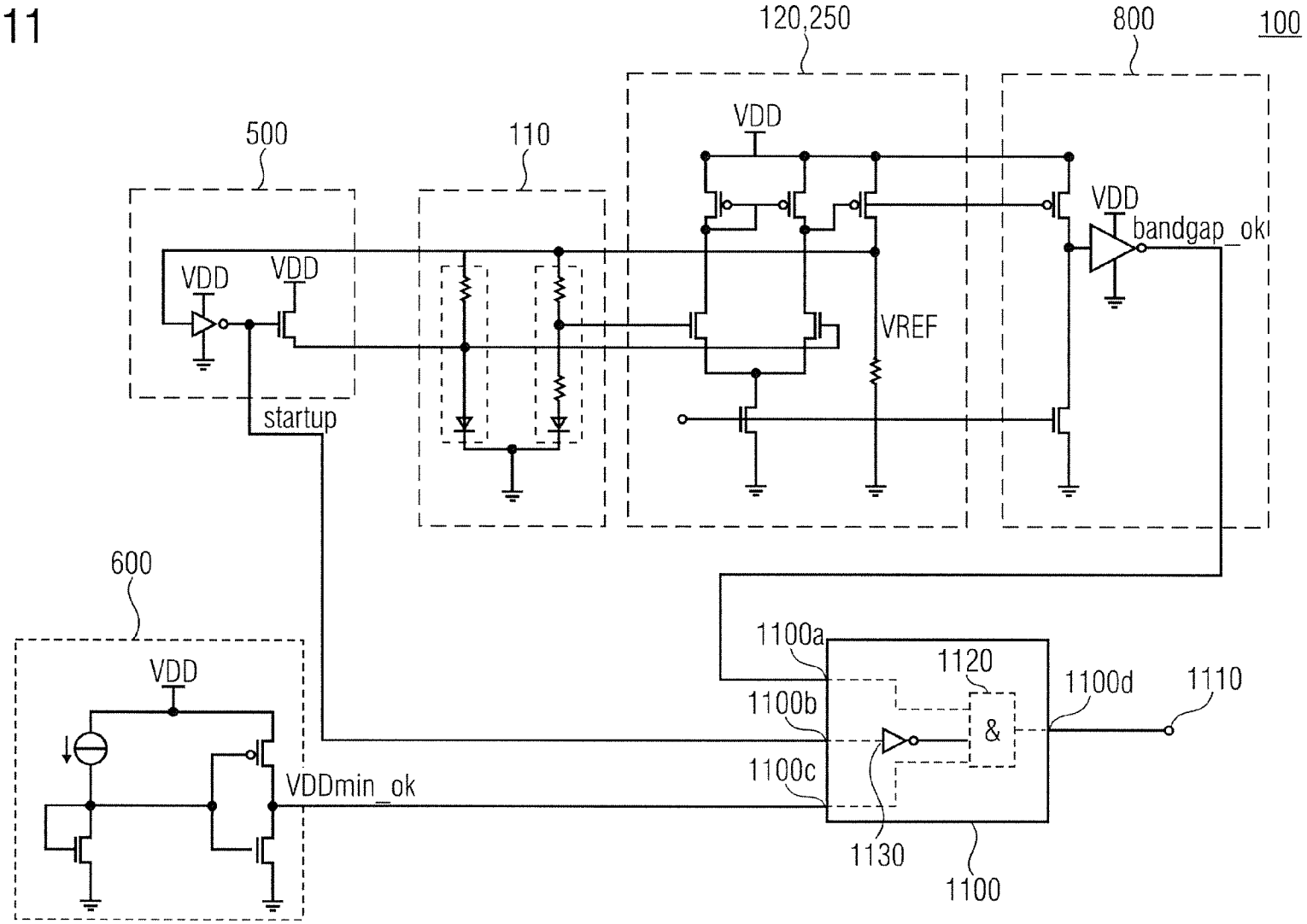
FIG. 11 shows a circuit diagram of a bandgap circuit according to an embodiment of the present invention.

The differential amplifier 250 may, for instance, be implemented as an operational amplifier or as a differential amplifier, an example of which will be illustrated in the context of FIGS. 10 and 11.

The bandgap circuit 100 further comprises the surveillance circuit 130. The surveillance circuit 130 comprises a comparator coupled with a first input to the output of the differential amplifier 250. The comparator 280 therefore receives during operation the potential VREF or, in other words, the feedback signal.

The surveillance circuit 130 further comprises a voltage divider 290 coupled in-between the terminal 300 for the power supply voltage and a terminal 310 for the reference potential. The voltage divider 290 comprises a series connection of a first resistor 320 and a second resistor 330, in-between which a node 340 is located, which, in turn, is coupled to a second input of a comparator 280. At the node 340, a divided voltage or a divided potential with respect to the present power supply voltage VDD_DIV is present.

Therefore, the comparator 280 is capable of comparing the potentials VDD_DIV and VREF provided as the feedback signal by the differential amplifier 250.

At an output of the comparator 280, a comparison signal VDD_OK is generated by the comparator indicating that the internally generated voltage VREF is sufficiently high for parts of the circuit not shown in FIG. 1 to be started. In other words, the comparator 280 compares the reference voltage VREF as output by the differential amplifier 250 of the feedback circuit 120 with a divided supply voltage VDD_DIV generated via the resistor chain comprising the two resistors 320, 330. When the internal supply voltage VREF is sufficiently high, this will be indicated by a signal VDD_OK, which may be used to initiate the start of the rest of the chip in which the bandgap circuit 100 may be integrated.

Naturally, also the comparator 280 is coupled to terminals for the power supply. To be more precise, the comparator 280 is coupled to a terminal for the power supply voltage 350 and to a terminal 360 for the reference potential (e.g. ground; GND).

In an implementation, the different terminals for the power supply voltage 260, 300, 350 as well as the different terminals for the reference potential 170, 270, 310, 360 may be coupled in parallel to a common terminal for the power supply voltage and the reference potential, respectively. If, for instance, the bandgap circuit 100 is integrated into a single integrated circuit (IC), the terminals for the power supply voltage 350 may be directly or indirectly connected to the corresponding terminal for the power supply voltage of the integrated circuit. Accordingly, also the different terminals for the reference potential may also be directly or indirectly connected to a common terminal of the integrated circuit.

In this context, it should be noted that two elements, circuits or objects, which are coupled to each other, may be directly or indirectly, via a third element, circuit or object, be connected to each other. As an example, in the circuit diagram shown in FIG. 1, the first node 180 is (indirectly) coupled to the feedback node 160 via the resistor 200, while the resistor 200 itself is (directly) coupled to the feedback node 160.

It is further to be noted that the two diodes 210, 240 may be replaced by devices having a diode-like current/voltage characteristic with respect to a threshold voltage. In other words, the two diodes 210, 240 may be replaced by bipolar transistors with short-circuited base terminals to either the emitter terminal or the collector terminal of the respective bipolar transistor. While in the preceding two examples the diode-like current/voltage characteristic is caused by an internal pn-junction or a np-junction, such a device to replace any of the two diodes 210, 240 may also be implemented in the form of a field effect transistor, such as an enhancement MOSFET (Metal Oxide Semiconductor Field Effect Transistor) with a short-circuited gate connect to either the drain terminal or the source terminal of the FET (Field Effect Transistor). Naturally, also other devices, such as a Zener diode may equally well be employed here. Alternatives and implementational details concerning such devices having a diode-like current/voltage characteristic with respect to a threshold voltage will be considered in more detail in the context of FIGS. 8, 9*a* and 9*b*.

Concerning the working principles of the circuit shown in FIG. 1, the bandgap reference circuit 110 typically comprises two current paths or branches 140, 150, each of the branches comprising a diode, although also implementations with only a single diode at one of the two branches may also be employed. Concerning the dimensioning of the two diodes 210, 240, an emitter area of the diode 240 is larger than that of diode 210. In series with (larger) diode 210, the resistor 200 is arranged forming the first branch 140. In series with diode 240, the two resistors 220, 230 are arranged forming the second branch 150. The resistors 200 and 220 are comparably dimensioned in the sense that their resistance values are ideally equal. In a real-life implementation, the two implemented resistors 200, 220 comprise resistance values, which do not differ from one another by more than a predefined margin, which, in turn, depends on a wide range of parameters including accuracy, costs, reproducibility and further parameters.

Figure 2:
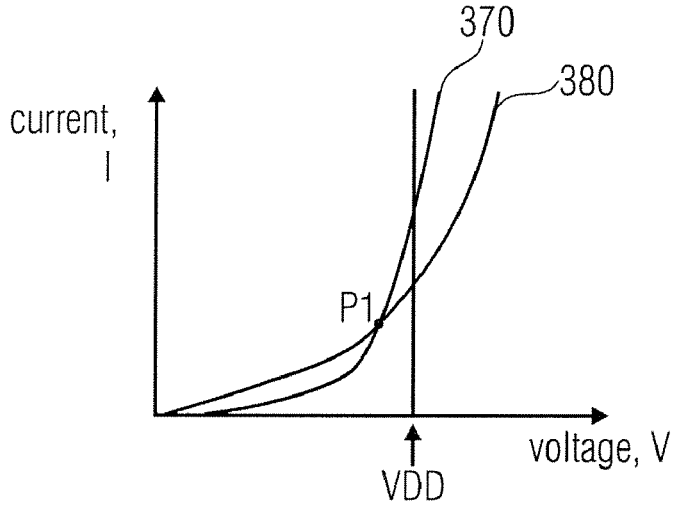
FIG. 2 shows current/voltage characteristics of two paths or branches of the bandgap reference circuit of FIG. 1.

Due to this dimensioning of the two resistors 200, 220 and the described differences concerning the emitter area of the two diodes 210, 240, the current/voltage characteristics of the two branches 140, 150 differ from one another. To illustrate this further, FIG. 2 shows a graph 370 of the current/voltage characteristic of the first branch 140. Accordingly, FIG. 2 also shows a second graph 380 of the current/voltage characteristic of the second branch 150.

Compared to the second graph 380 of the current/voltage characteristics of the second branch 150, graph 370 shows a significantly more pronounced behavior. For larger voltages, a significantly higher current flows through the first branch 140 and the corresponding first node 180. On the other hand, for smaller voltages, the current through the first branch 140 and the first node 180 is smaller than that through the second branch 150 and the second node 190. This is caused by the different emitter areas of the two diodes 210, 240, which result in the described more pronounced current/voltage characteristic of the first branch 140, which is a direct consequence of the current/voltage characteristic of the corresponding diode 210.

In an equilibrium or an equilibrium state of the bandgap reference circuit 110, the current through the first branch 140 and the second branch 150 are equal, which corresponds to a point of operation, which is denoted in FIG. 2 as P1. Since the resistance values of the two resistors 200, 220 are ideally equal and in a real-life implementation sufficiently comparable, the two nodes 180, 190 comprise the same potential with respect to the reference potential present at the terminal 170 in the equilibrium.

Therefore, the differential amplifier 250 is coupled to the nodes 180, 190 of the current paths and tunes the voltage provided to the feedback node 160. Therefore, the bandgap reference circuit 110 and the feedback circuit 120 form a close feedback loop, so that the feedback of the differential amplifier 250 will result in a minimum voltage difference of the first and second nodes 180, 190. When the differential amplifier 250 is in the equilibrium previously described, a temperature compensated reference voltage VREF is obtainable at the feedback node 160 and, naturally, also at the output of the differential amplifier 250.

However, with respect to the circuit shown in FIG. 1 and the current/voltage characteristics shown in FIG. 2, the question arises as to what happens when the (external) supply voltage of the differential amplifier is not sufficiently high, since the differential amplifier 250 is coupled to the terminal 260 for the power supply voltage. The circuit shown in FIG. 1 may, in such a case, show a behavior that in the case of such an error, the theoretically highest output voltage, which the differential amplifier 250 is capable of creating at the feedback node 160, is equal to the externally supplied supply voltage VDD. In FIG. 2, it is also indicated by an arrow with respect to the voltage axis (abscises), which is marked VDD. In this context, also the voltage drop across the two resistors 200, 220 is to be taken into account.

In the case of an error or a slow start-up of the supply voltage, when the internal supply voltage is not sufficiently high, the equilibrium of the potential of the two nodes 180, 190 (cf. point P1 in FIG. 2) cannot be reached. The reference voltage VREF as provided by the differential amplifier 250 is, in such a case, typically not reliable and smaller than the value to be expected. In an implementation based on silicon diodes (Si), the reference voltage VREF is typically 1.2 V, such that in the case of an error, the reference voltage VREF as provided by the differential amplifier 250 is smaller than the previously mentioned 1.2 V.

In conventional bandgap circuits, monitoring or surveillance of the correct mode of operation and, therefore, the monitoring of the correct level of the reference voltage VREF is not implemented. In the case that the absolute value of the reference voltage VREF is not the expected value (e.g. 1.2 V), the comparison of the voltage VREF with the voltage based upon the supply voltage VDD will lead to a wrong result. As a consequence, the signal VDD_OK will be provided by the comparator 280 at a supply voltage VDD being lower than the expected value and the chip or integrated circuit comprising the bandgap circuit 100 shown in FIG. 1 may not be started in its specified working parameters.

This may lead to a situation which does not allow the corresponding integrated circuit to determine whether the signal VDD_OK output by the comparator 280 or a similar signal indicative of the same or a similar situation is correct and trustworthy. During the start-up-phase it might, for instance, happen that the signal VDD_OK oscillates unintentionally due to uncontrolled voltages at the inputs of the comparator 280.

According to embodiments of the present invention, a monitoring of several internal nodes of the bandgap reference circuit 110 including the feedback loop in the form of the feedback circuit 120 is implemented to enable a more precise recognition of the state of the bandgap reference circuit. According to embodiments of the present invention, three conditions will be monitored, which will be outlined in more detail with reference to FIGS. 3 and 4:

1. Recognition of the minimum required voltage at the nodes 180, 190;
2. Recognition of the minimum required supply voltage for the differential amplifier 250;
3. Precise recognition of the equilibrium (point P1 in FIG. 2) of the differential amplifier 250.

According to different embodiments of the present invention, any of the previously mentioned conditions may be individually, concerning a sub-set or, simultaneously together being monitored by the corresponding evaluation circuit, as will be outlined in more detail below.

Figure 3:
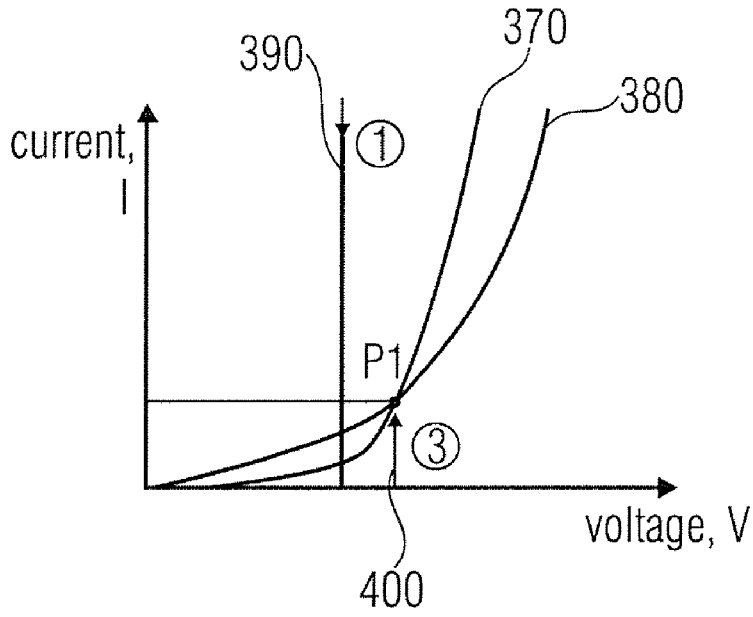
FIG. 3 illustrates determining a sufficient voltage for two nodes of the bandgap reference circuit of FIG. 1 and the precise determination of an equilibrium or equilibrium state of the bandgap reference circuit based on the current/voltage characteristics shown in FIG. 2.

FIG. 3 illustrates the first and the third condition as mentioned above. To be more precise, FIG. 3 illustrates the current/voltage characteristics (I/V characteristics) 380, 390 of the two branches 140, 150 of the bandgap reference circuit 110 of FIG. 1 along with the equilibrium point P1, which corresponds to a state in which the differential amplifier 250 takes care of providing an ideally identical current flow through the first and the second nodes 180, 190 of the two branches 140, 150. Concerning the first point mentioned above, the recognition of the minimum required voltages at the two nodes 180, 190 is illustrated by a line 390 denoted by an arrow accompanied by an encircled 1. When the voltage V becomes larger than the value indicated by the line 390, the voltages present at the two nodes 180, 190 is sufficiently high to lower the differential amplifier 250 and the feedback circuit 120 to operate reliably and to drive the bandgap reference circuit 110 into the equilibrium state. Moreover, FIG. 3 also indicates the third point mentioned above indicated by an arrow 400 accompanied by an encircled 3 in FIG. 3. The arrow 400 illustrates the precise recognition of the equilibrium point P1 of the differential amplifier 250.

Figure 4:
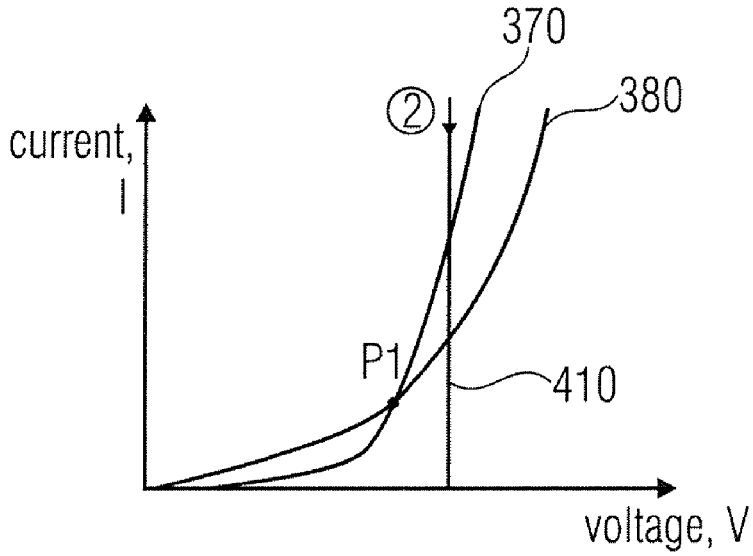
FIG. 4 shows a determination of a minimum required supply voltage for a differential amplifier of a feedback circuit of the bandgap reference circuit shown in FIG. 1 based on the current/voltage characteristics of FIG. 2.

Concerning the second condition of the recognition of the minimum required supply voltage of the differential amplifier 250 mentioned above, FIG. 4 illustrates, once again, the two graphs 370, 380 of the current/voltage characteristics of the two branches 140, 150. In FIG. 4, a line 410 is shown and indicated by an arrow accompanied by an encircled 2 indicating a lower limit of the voltages supplied to the circuit to enable a reliable operation of the differential amplifier 250. For voltages being larger than the value indicated by line 410 in FIG. 4, the differential amplifier 250 will be able to operate reliably so as to close the feedback loop formed by the bandgap reference circuit 110 and the feedback circuit 120.

Monitoring on or more of the above-mentioned conditions may have the effect that the reliability of the generated reference voltage VREF may be recognizable by the digital signal bandgap VDD_OK provided by an evaluation or surveillance circuit. Only when this signal of the evaluation circuit is present, is the reference voltage VREF used as a reliable absolute voltage level for recognizing the supply voltage level of the circuit. Employing embodiments according to the present invention may therefore have the effect that the erroneously provided enabling signal to start the chip, the integrated circuit or the circuit comprising the bandgap reference circuit 110 at a voltage level being too low may be prevented.

Embodiments according to the present invention are based on the finding that an already implemented differential amplifier in the framework of the feedback circuit 120 for the bandgap reference circuit 110 may be used and extended by implementing additional circuitry to monitor the previously mentioned conditions. For instance, the differential amplifier 250 may be provided with an additional output stage that provides a signal indicative of reaching the equilibrium or working point of the bandgap reference circuit 110. With a signal comprising an information indicating recognition of the working point, the generated reference voltage may be used for a reliable comparison with other voltages in the further cause of the circuit.

Moreover, concerning the other three conditions mentioned above, embodiments according to the present invention are based on the finding that coupling one of the two nodes 180, 190 to the terminal for the external supply voltage until a predefined voltage condition is met, so that one of the two nodes 180, 190 is brought to a voltage condition during the start-up procedure of the circuit, so that the differential amplifier 250 is forced to recognize a non-equilibrium state. When the predetermined voltage condition is met, however, the corresponding node of the two nodes 180, 190 will be decoupled from the terminal for the (external) power supply voltage to enable an undisturbed mode of operation of a closed feedback loop. Naturally, only one of the two nodes 180, 190 is to be coupled to the terminal for the external power supply voltage until the voltage condition is met.

With respect to the condition of recognizing a minimal required supply voltage for the differential amplifier 250, embodiments according to the present invention are based on the finding that this can be achieved by implementing a monitoring circuit, as outlined and described in more detail below. The monitoring circuit comprises a device having a diode-like current/voltage characteristic with respect to a threshold voltage and a current source, which together resemble an electrical behavior of the corresponding circuitry part of the differential amplifier 250. An additional logic circuit coupled to the previously mentioned device and the current source then provides an appropriate status signal indicating reaching the sufficient voltage level.

Figure 5:
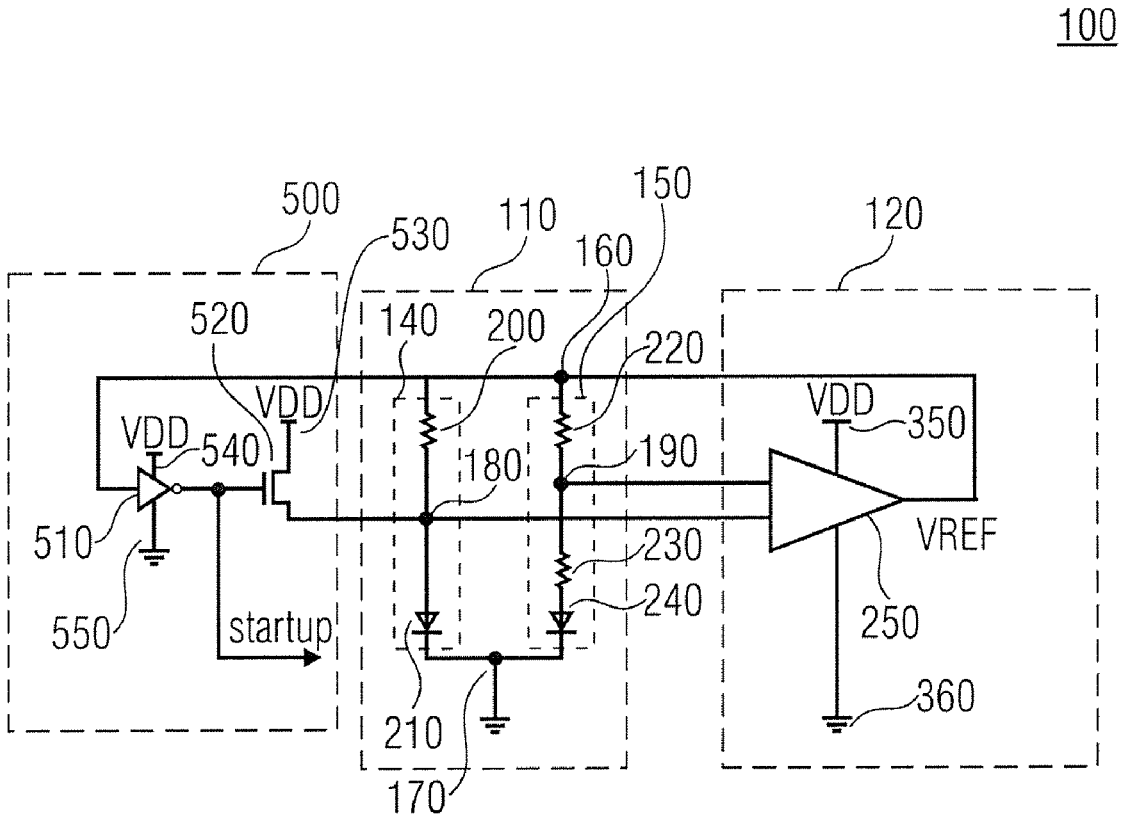
FIG. 5 shows a circuit diagram of a starter circuit for a bandgap circuit according to an embodiment of the present invention.

Concerning the first condition of recognizing a minimum required voltage at the nodes 180, 190 of the bandgap reference circuit 110, FIG. 5 shows a circuit diagram of a corresponding embodiment according to the present invention. The circuitry shown in FIG. 5 differs from that shown in FIG. 1 with respect to the fact that the surveillance circuit 130 is not shown. Concerning the bandgap reference circuit 110, as well as the feedback circuit 120, FIG. 5 does not differ from the circuit shown in FIG. 1, due to which references is made to the previous description of FIG. 1. However, it should be noted that the implementation of the surveillance circuit 130, although not shown in FIG. 5, may be optionally implemented as a circuit for monitoring a sufficient voltage level of the external supply voltage VDD. In other words, although the surveillance circuit 130 is not shown in FIG. 5, it may well be implemented as an optional component.

The embodiment shown in FIG. 5 does, however, comprise a starter circuit 500. The driver circuit comprises an input, which is coupled to the feedback node of the bandgap reference circuit 110 and the output of the differential amplifier 250. Moreover, the starter circuit 500 comprises an output, which is coupled to the first node 180 of the first branch 140 of the bandgap reference circuit 110.

Internally, the starter circuit 500 comprises a driver circuit 510 in the form of an inverter, for instance, a CMOS inverter (CMOS=Complementary Metal Oxide Semiconductor). To be more precise, the input of the starter circuit 500 is coupled to the input of the driver circuit 510. An output of the driver circuit 510 is coupled to a control terminal of a transistor 520, which in the circuitry shown in FIG. 5, is a field effect transistor. To be even more precise, the transistor 520 shown in FIG. 5 is an n-channel enhancement MOSFET, so that the control terminal of the transistor 520 is its gate terminal. A drain terminal of the transistor 520 is coupled to a terminal 520 for the power supply voltage VDD. A source terminal of the transistor 520 is coupled to the first node 180 of the first branch 140 of the bandgap reference circuit 110. Naturally, also the driver circuit 510 in the form of an inverter is coupled to a terminal 540 for the supply voltage VDD and to a terminal 550 for the reference potential, for instance, ground (GND). As outlined above, the two terminals 530, 540 for the supply voltage may be directly or indirectly connected to the corresponding terminal of an integrated circuit comprising the circuit 100. In addition, the terminal 550 for the reference potential may be connected to a corresponding terminal of the integrated circuit.

The bandgap circuit 100 shown in FIG. 5 comprises the starter circuit 500, which takes care of keeping the voltage of the first node 180 at a different voltage level than that of the reference potential as a starting value. In other words, the starter circuit 500 takes care of providing a starting value for the voltage being different than 0 V to the first node 180. When a supply voltage VDD is applied, the reference voltage VREF as provided by the differential amplifier 250 is, in its initial moment, equal to 0 V. The transistor 520, controlled by the driver circuit 510 or inverter 510 is turned on by the driver circuit 510 when the supply voltage is higher than the threshold voltage of the transistor 520. When this happens, the inverter or driver circuit 520 takes care of boosting the voltage level present at the first node 180 of the first branch 140 of the bandgap reference circuit 110 by coupling the first node 180 to the terminal for the supply voltage 530.

Only when the differential amplifier 250 provides a reference voltage VREF with the level being above the switching threshold of the inverter or driver circuit 510, which is provided with the supply voltage VDD via the terminal 540, is the transistor 520 turned off and the differential amplifier 250 may independently take care of reaching the equilibrium point P1 as shown in FIGS. 2 to 4.

A status signal "start-up" comprising an information as to whether the starter circuit 500 is activated or deactivated is obtainable at the output of the inverter 510 and at the control terminal (i.e. gate terminal) of the transistor 520. Hence, the activation or deactivation of the start-up circuit 500 can be recognized in the implementation according to an embodiment of the present invention by monitoring the signal start-up.

In different embodiments according to the present invention, the transistor 520 as well as other transistors appearing in other circuits and embodiments according to the present invention may well be replaced by corresponding depletion field effect transistors, p-channel field effect transistors, bipolar transistors or other transistors. Depending on the concrete dimensioning of the respective circuit elements, the transistor 520 shown in FIG. 5 may, for instance, be replaced with an n-channel depletion field effect transistor, an NPN-bipolar transistor or another suitable transistor. Adapting the circuit concerning its polarity, also corresponding p-channel field effect transistors as well as PNP-bipolar transistors may equally well be used. The flexibility concerning replacing the transistor 520 is also indicated by referring to the gate terminal of the field effect transistor 520 shown in FIG. 5 as a control terminal. In the case of a bipolar transistor, the control terminal is, for instance, the basis terminal.

Figure 6:
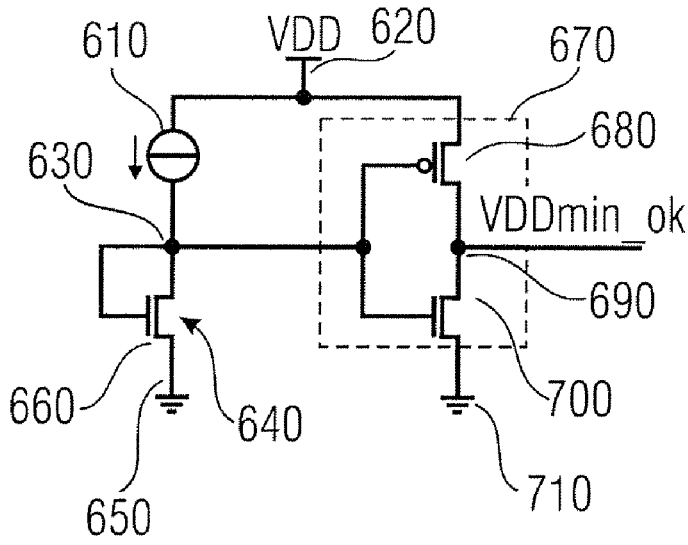
FIG. 6 shows a circuit diagram of a monitoring circuit according to an embodiment of the present invention.

Concerning the second condition mentioned above, FIG. 6 shows a circuit diagram for recognizing a minimum required supply voltage. To be more precise, FIG. 6 shows a monitoring circuit 600 comprising a current source 610 coupled with a first terminal to a terminal 620 for the supply voltage VDD. The current source 610, which may, for instance, be implemented as a transistor, is coupled with a second terminal to an internal node 630.

A device 640 having a diode-like current/voltage characteristic with respect to a threshold voltage is coupled in-between the internal node 630 and a terminal 650 for the reference potential. In the circuitry shown in FIG. 6, the device 640 is formed by an n-channel enhancement MOSFET 660, which is coupled with both its drain terminal and its gate terminal to the internal node 630. The source terminal of the MOSFET 660 is coupled to the terminal 650 for the reference potential.

The monitoring circuit 600 further comprises a logic circuit 670, which is formed as a CMOS inverter (complementary metal oxide semiconductor). The logic circuit 670 comprises an input coupled to the internal node 630 and an output at which a status signal VDDmin_ok is obtainable indicating a sufficient minimum supply voltage being present to operate the differential amplifier 250 of the circuitry shown in FIGS. 1 and 5.

The logic circuit 670, being implemented as a CMOS inverter, comprises a p-channel field effect transistor coupled with a source terminal to the terminal 620 for the supply voltage and with a drain terminal to a further internal node 690 representing the output of the logic circuit 670 at which the status signal VDDmin_ok is obtainable. A gate terminal of the transistor 680 is coupled to the input of the logic circuit 670 and, hence, to the internal node 630.

The logic circuit 670 also comprises an n-channel field effect transistor 700, which is coupled to the further internal node 690 with its drain terminal. A source terminal of the transistor 700 is coupled to a terminal 710 for the reference potential. A gate terminal or control terminal of the transistor 700 is coupled in parallel with the gate terminal of the transistor 680 to the input of the logic circuit 670 and, hence, to the internal node 630.

Concerning its operational principles, the monitoring circuit 600, according to an embodiment of the present invention, allows a coarse recognition of the presence of a minimum supply voltage by employing an inverter comprising the transistors 680, 700. An input voltage of the inverter 670 is generated by the transistor 660 being wired as a diode with the fairly inaccurate current source 610 being connected in series herewith. As mentioned above, the current source 610 may be realized by employing a transistor and providing the control terminal of the transistor with a corresponding voltage, for instance, the power supply voltage present at the terminal 620.

Naturally, also the terminal 620 for the supply voltage as well as the terminal 650, 710 for the reference potential may, once again, be coupled to the respective terminals for the supply voltage and the reference potential, respectively, of a chip, integrated circuit or circuit comprising the monitoring circuit 600.

During the supply voltage VDD becoming larger and larger, the internal node 630 comprises a voltage V_intern following that of the supply voltage until the current through the transistor 660 starts to grow more rapidly due to the diode-like current/voltage characteristic of the corresponding device 640 of which the transistor 660 is a part. In other words, the voltage V_intern present at the internal node 630 remains approximately unchanged according to the diode-like current/voltage characteristic of the device 640 and a constant value of the current provided by the current source 610.

To realize the current source 610 in the described way, the gate terminal of the transistor forming the current source 610 may, for instance, be provided with a voltage derived from the externally supplied supply voltage VDD. For instance, a voltage divider, such as the voltage divider 290 shown in FIG. 1, may be used to derive the voltage for the corresponding transistor of the current source 610. Naturally the control terminal may equally well be coupled to a terminal for the power supply voltage.

The inverter 670 will then provide the status signal VDDmin_ok having a high voltage level when the supply voltage VDD becomes larger than the sum of the threshold voltages of the two transistors 680, 700 forming the CMOS inverter 670. Naturally, the switching border of the inverter strongly depends on the inaccurate current source 610, the dimensioning of the transistors 680, 690, 660 and the process conditions and the temperature of the circuit. This, however, does not represent a serious problem for the monitoring circuit 600, since it is only intended to provide a cause recognition of the presence of a minimum required supply voltage VDD.

Figure 7:
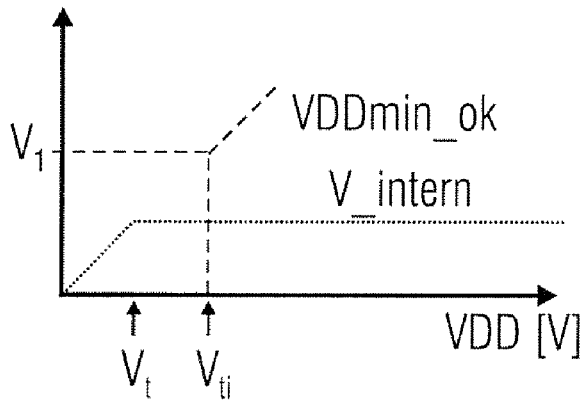
FIG. 7 shows a graph of two voltages present in the monitoring circuit of FIG. 6 as a function of the power supply voltage.

FIG. 7 shows a comparison of the voltages or potentials VDDmin_ok and V_intern present at the output of the inverter 670 at the further internal node 690 and at the input of the inverter 670 at the internal node 630, respectively, as a function of the externally supplied supply voltage VDD. Starting from the vanishing external supply voltage VDD (VDD=0 V), the potential or voltage at the internal node 630 starts to rise along with the externally supplied supply voltage VDD until the threshold voltage Vt of the device 640 is reached. From then on, further increasing the externally supplied voltage VDD will not, or will not significantly, result in a further increase of the potential V_intern present at the internal node 630.

During this phase, however, the voltage VDD is smaller than the sum of the threshold voltages of the two transistors 680, 700. Accordingly, the potential of the further internal node 690 VDDmin_ok remains at the ground level or 0 V. When the externally supplied voltage VDD becomes larger than a voltage level Vti being the combined threshold voltages of the two transistors 680, 700 forming the inverter 670, the status signal with its voltage level VDDmin_ok rises abruptly from 0 V to a voltage level $V_1$ as shown in FIG. 7. Further increasing the external supply voltage VDD will result in a further increase of the voltage VDDmin_ok as shown in FIG. 7.

Figure 8A:
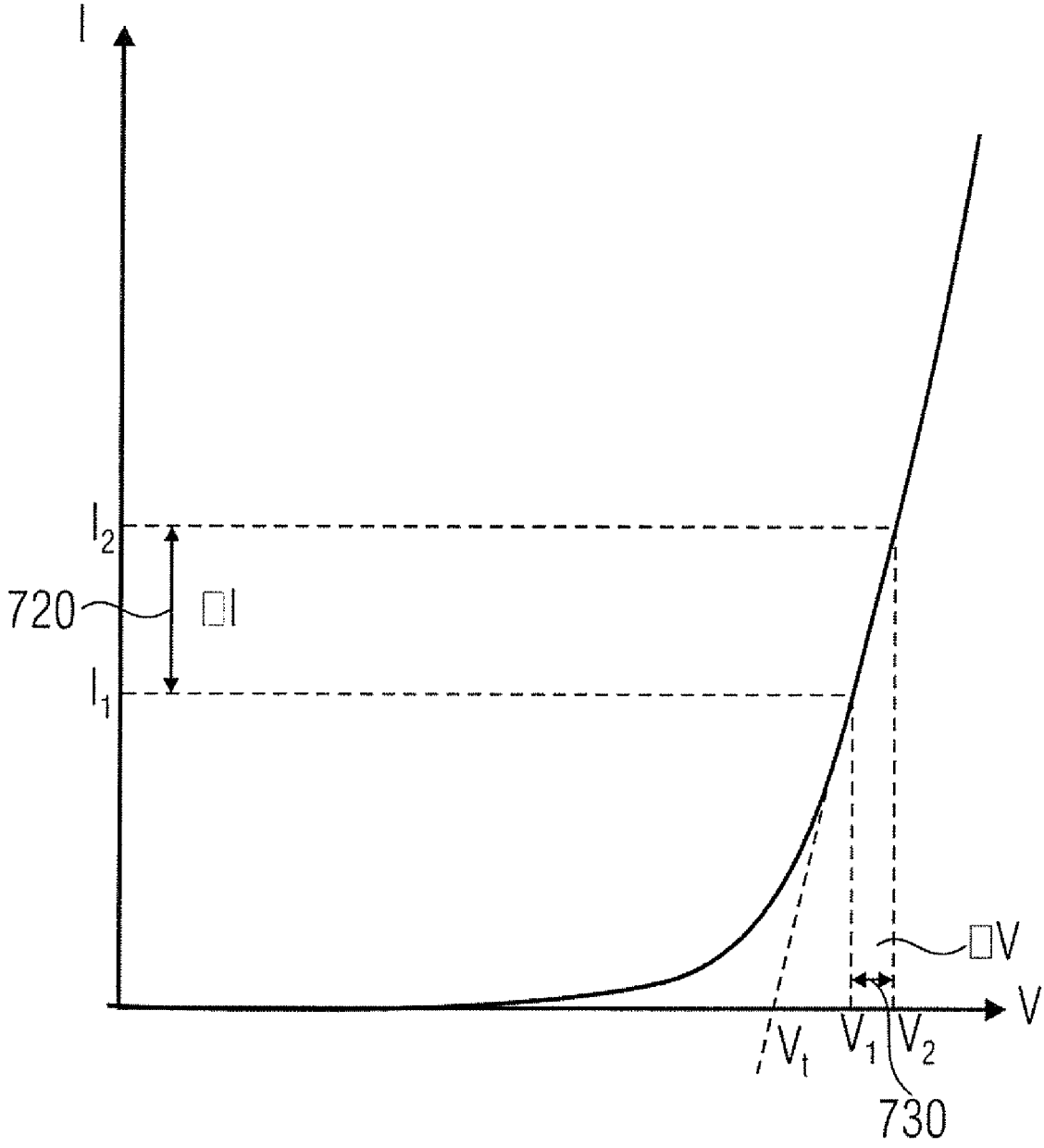
FIG. 8*a* shows schematically a current/voltage characteristic of a device having a diode-like current/voltage characteristic employed, for instance, in a monitoring circuit as shown in FIG. 6.
Figure 8B:
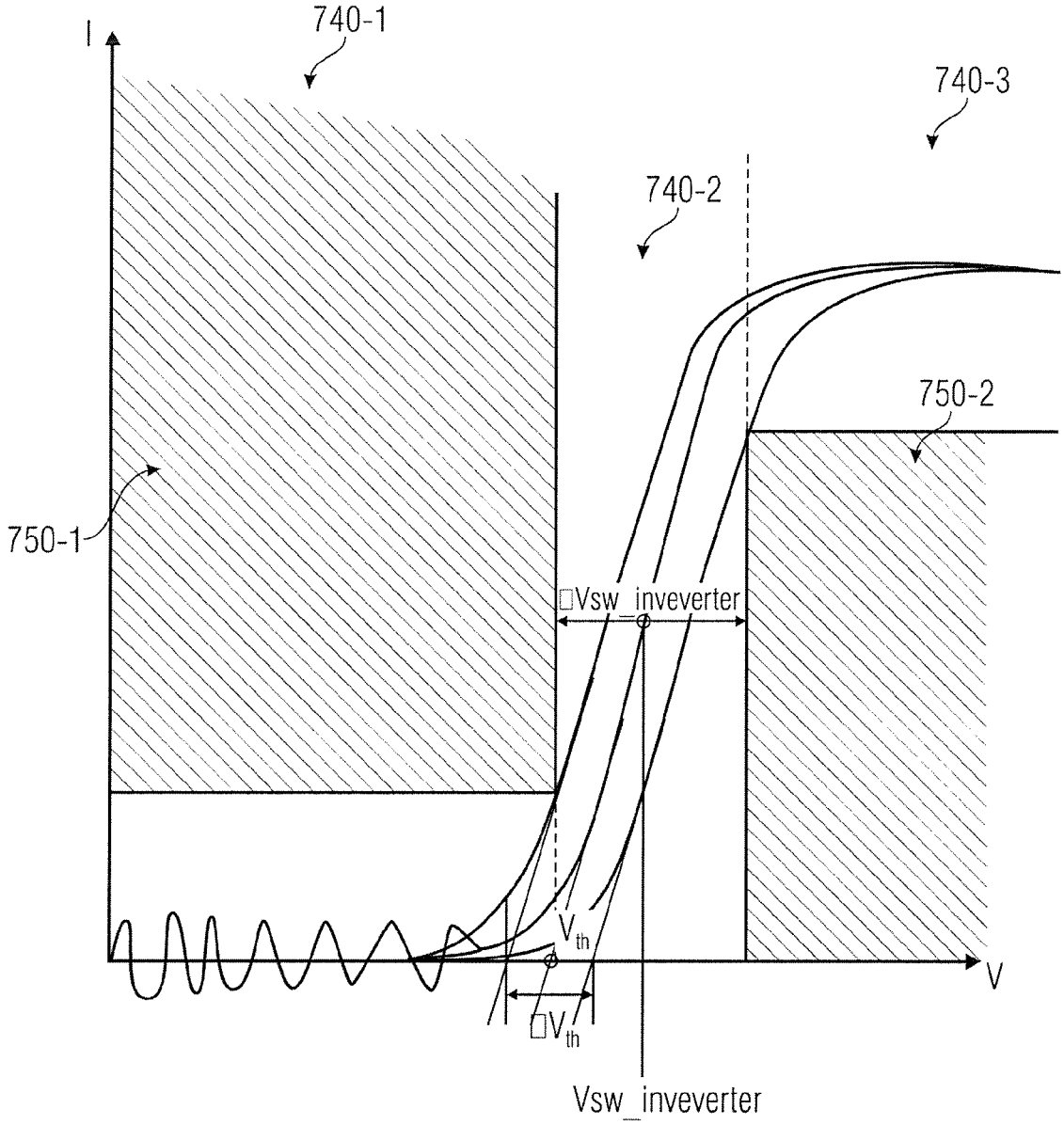
FIG. 8*b* schematically illustrates properties of a diode-like current/voltage characteristic.

As outlined above, the device 640 shown in FIG. 6 comprises a diode-like current/voltage characteristic as schematically depicted in FIGS. 8*a* and 8*b*. Such a device 640 can be implemented in a vast number of ways, a few of which will be discussed here. To implement a diode-like current/voltage characteristic with respect to a threshold voltage Vt, which is sometimes also referred to as a cut-in voltage, may be accomplished as shown in FIG. 6 by using an enhancement field effect transistor with a short-circuited gate terminal. In the case of such a device, increasing the voltage (source-drain voltage) will first result in a negligible current flowing through the transistor, since the channel has not opened yet. When the voltage applied to the device 640 approaches the threshold voltage Vt, the current starts to increase dramatically. As a good approximation, the current I flowing through the device 640 does not significantly depend on the applied voltage so that, in principle, the voltage is fixedly kept at the threshold voltage Vt. This is, however, only a very rough estimate. In many cases, the threshold voltage is not only a well-defined property, but a more or less arbitrarily fixed parameter.

However, as a good approximation for a diode-like current/voltage characteristic with respect to a threshold voltage Vt, the device can be considered having a current/voltage characteristic with a quasi-constant voltage drop for a plurality of current values above or below the threshold voltage. To illustrate this, FIG. 8*a* illustrates a current interval 720 and a voltage interval 730 of the diode-like current/voltage characteristic for voltages larger than the threshold voltage Vt. The current interval 720 having a magnitude of $\Delta I = I_2 - I_1$ and the current interval 730 having a magnitude of $\Delta V = V_2 - V_1$, the expression $$\frac{\Delta I}{\bar{I}} \cdot \left(\frac{\Delta V}{\bar{V}}\right)^{-1} = f(V_1, V_2), \tag{1}$$

wherein $\bar{I}$ and $\bar{V}$ are given by $$\bar{I} = \frac{1}{2} \cdot (I_1 + I_2) \tag{2}$$

$$\bar{V} = \frac{1}{2} \cdot (V_1 + V_2) \tag{3}$$

is a function of the voltages $V_1$ and $V_2$.

For a device having a non-linear current/voltage characteristic, the function $f(V_1, V_2)$ according to equation (1) may acquire values being different than 1. In contrast, a linear current/voltage characteristic (e.g. an Ohmic resistor) will have a constant value of 1.

Moreover, the voltages being larger than the threshold voltage Vt as illustrated in FIG. 8*a*, the function $f(V_1, V_2)$ acquires values larger than 1. Therefore, a diode-like current/voltage characteristic with respect to a threshold voltage Vt may alternatively be defined based on equation (1) by stating that for voltages $V_1$ and $V_2$ being larger than Vt, the function acquires values being larger than a predetermined value, e.g. 1.05, 1.1, 2, 2.5, 3, 10 or any other values based on the dimensioning, the technical feasible voltages and currents and other parameters suitable for the respective circuit.

For voltages $V_1$ and $V_2$ being smaller than the threshold voltage Vt, the function according to equation (1) comprises values, which are typically smaller than 1 or a predefined lower limit, which can easily be seen from FIG. 8*a*, since for voltages below Vt, the characteristic comprises a comparably flat behavior.

This definition of a diode characteristic or a diode-like current/voltage characteristic is in line with that previously given, the voltages $V_1$ and $V_2$ being larger than Vt and maybe considered to be "almost identical". In other words, the two voltage values $V_1$ and $V_2$ may be viewed—as an approximation—as being a constant or quasi-constant value. Therefore, the current/voltage characteristic as shown in FIG. 8*a* comprises a plurality of current values ($I_2$, $I_1$) above the threshold voltage Vt.

For larger or—in the case of negative voltages—smaller voltages, the current may saturate, leading again to a comparably flat current/voltage characteristic. However, this is no contradiction, since the above considerations do not have to apply to all voltage values or current values.

Another approach to describe a diode-like current/voltage characteristic is schematically depicted in FIG. 8*b*. The relevant continuous voltage sub-range (e.g. positive voltages up to a maximum voltage) is divided into three adjacent regimes 740-1, 740-2 and 740-3, which together comprise the voltage sub-range.

A width of the second regime 740-2 maybe defined by a typical spread ΔVsw_inveverter of switching points Vsw_inveverter of device or component switched behind the respective device having the diode-like current/voltage characteristic. Since in some embodiments according to the present invention the relevant device is an inverter, the voltages of the switching points are denoted by Vsw_inveverter in FIG. 8*b*.

A width of the first regime 740-1 may be determined by the characteristic or threshold voltage $V_{th}$ (=Vt) and by its spread $\Delta V_{th}$ due to process and/or temperature variations. Inside the first regime 740-1 a maximum current is definable, which is not acquired by a current/voltage characteristic in the first regime 740-1. Accordingly, in the first regime 740-1 a first area 750-1 above the maximum current and having a width of the first regime 740-1 limits the current/voltage values of the current/voltage characteristic.

In the third regime a second area 750-2 is definable below a minimum current acquired by the current/voltage characteristics of the device. Typically, the width of the first and third regimes 740-1, 740-3 is larger (e.g. at least twice as large) than the second regime 740-2, while the minimum current in the third regime 740-3 is at least twice as large as the maximum current in the first regime 740-1.

As a consequence, the current voltage characteristics are limited in the regime 740-1 to values outside the first area 750-1 and in the third regime 740-3 to values outside the second area 750-2. Along with the second regime 740-2 a tube-like area is therefore defined in which the current/voltage characteristics extend. The extension of the tube-like area is limited by the process and/or temperature variations of the characteristic voltage $\Delta V_{th}$ and the switching points of the following device ΔVsw_inveverter. This definition is also in line with diode-like I/V-characteristics showing a saturation behavior in the upper voltage regime 740-3.

Figure 9A:
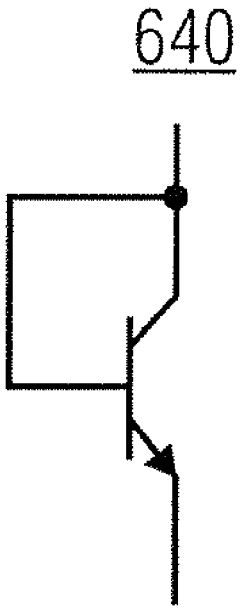
FIGS. 9*a* and 9*b* show further embodiments of the device having a diode-like current/voltage characteristic as, for instance, employed in the monitoring circuit of FIG. 6.
Figure 9B:
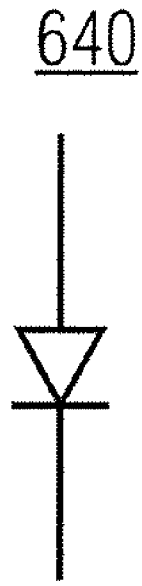

However, as indicated above, the threshold voltage Vt significantly depends on the device 640 and may, to some extent, be arbitrarily chosen. To illustrate this further, FIGS. 9*a* and 9*b* show two alternative implementations of a device 640 having a diode-like current/voltage characteristic with respect to a threshold voltage. To be more precise, FIG. 9*a* shows an NPN-bipolar transistor with a short-circuited bias terminal coupled to its collector terminal, while FIG. 9*b* shows a diode. Both devices may be fabricated from different semiconducting materials and are based on the presence of a pn-junction or an np-junction. For such a device, the current/voltage characteristic comprises an exponential behavior in the forward biased mode of operation. The threshold voltage or cut-in voltage typically lies in the range of 0.6 V to 0.7 V for devices based on silicon. However, depending on the technology and materials involved, other threshold voltages or cut-in voltages may also be realized. For instance, in the case of light-emitting diodes, corresponding threshold voltages can go up as high as 4.0 V.

Concerning the third condition of a precise recognition of the equilibrium point of the differential amplifier 250, FIG. 10 shows a circuit diagram of a bandgap circuit 100 according to an embodiment of the present invention. The bandgap circuit 100 of FIG. 10 differs from those shown in FIGS. 1 and 5 with respect to the feedback circuit 120 and with respect to an additional output stage 800, which provides a status signal comprising an information indicative of the bandgap reference circuit reaching the equilibrium. However, the circuit 100 shown in FIG. 10 also comprises a bandgap reference circuit 110, which is identical to the bandgap reference circuit 110 shown in FIG. 1. Therefore, reference is made to the corresponding parts of the description of FIGS. 1 and 5.

While the feedback circuit 120 and the differential amplifier 250 have, so far, been shown and implemented as operational amplifiers, the circuit diagram shown in FIG. 10 illustrates a more transistor-based implementation of a differential amplifier along with its output stage. The differential amplifier 250 comprises a first PMOS transistor 810, a second PMOS transistor 820 and a third PMOS transistor 830 (PMOS=P-channel MOS Transistor; MOS Metal Oxide Semiconductor), which are each coupled with their respective source terminals to a terminal 260 for the supply voltage VDD. The first and the second PMOS transistors 810, 820 are coupled with their respective gate terminals to a drain terminal of the PMOS transistor 810, hence forming a current mirror circuit. The drain terminal of the first PMOS transistor 810 represents a first internal node 840 of the differential amplifier, while the drain terminal of the second PMOS transistor 820 forms a second internal node 850.

The differential amplifier 250 further comprises a first NMOS transistor 860 and a second NMOS transistor 870 (NMOS=n-channel MOS Transistor; MOS=Metal Oxide Semiconductor). A drain terminal of the first NMOS transistor 860 is coupled to the drain terminal of the first PMOS transistor 810 and to the first internal node 840. A drain terminal of the second NMOS transistor 870 is coupled to the drain terminal of the second PMOS transistor 850 and to the second internal node 850. Source terminals of the first and the second NMOS transistors 860, 870 are coupled in parallel to a third internal node 880, which is also coupled to a drain terminal of a third NMOS transistor 890. A source terminal of a third NMOS transistor 890 is coupled to a first terminal for the reference potential 270-1 of the feedback circuit 120. A gate terminal or control terminal of the third NMOS transistor 890 is coupled to a terminal 900 for a control terminal provided to the third NMOS transistor 890 to operate it as a current source.

A gate terminal of the first NMOS transistor 860 is coupled to the second node of the bandgap reference circuit 110, while a gate terminal of the second NMOS transistor 870 is coupled to the first node of the bandgap reference circuit 110. In other words, the gate terminal of the first NMOS transistor 860 represents the inverting input of the differential amplifier 250, while the gate terminal of the second NMOS transistor 870 represents the non-inverting input of the differential amplifier 250.

A gate terminal of the third PMOS transistor 830 is coupled to the drain terminal of the second PMOS transistor 820 and, as a consequence, also to the second internal node 850 of the differential amplifier 250. A drain terminal of the third PMOS transistor 830 is coupled to an internal feedback node 940, which is connected to the feedback node 160 of the bandgap reference circuit 110 and to a resistor 950, which is coupled in-between the internal feedback node 140 and a second terminal for the reference potential 270-2. As shown in FIG. 10, at the internal feedback node 940, during operation of the circuit 100, the reference voltage VREF is present. Hence, the internal feedback node 940 represents the output of the feedback circuit 120 and the differential amplifier 250, providing the feedback signal to the bandgap core circuit 110. Therefore, the third PMOS transistor 830, along with the resistor 950, is sometimes also referred to as the output stage of the differential amplifier.

However, as previously noted, the bandgap circuit 100 further comprises the output stage 800. The output stage 800 comprises a PMOS transistor 960, which is coupled with a source terminal to the terminal for the power supply voltage 260. With a gate terminal, it is furthermore coupled to the second internal node 850 of the differential amplifier 250. With a drain terminal, it is coupled to an internal node 970 which, in turn, is coupled to an input of an inverter 980. Apart from the internal node 970, the inverter is also coupled to a terminal 990 for the power supply voltage VDD and to a terminal 1000 for the reference potential. At an output of the inverter 980, a status signal "bandgap_ok" comprising an information indicative of the bandgap reference circuit 110 reaching its equilibrium is provided.

The internal node 970 of the output stage 800 is furthermore coupled to a drain terminal of a NMOS transistor 1010, the source terminal of which is coupled to a terminal 1020 for the reference potential. A gate terminal of the NMOS transistor 1010 is coupled, in parallel, to the terminal 900 for the control voltage. Therefore, the NMOS transistor 1010 is also operating as a current source.

As a side remark, it should be noted that, once again, the terminals for the reference potential 170, 270, 1020 may naturally be connected to a single terminal for the reference potential of an integrated circuit or a chip comprising the bandgap circuit 100. In addition, the terminals 260, 990 for the power supply voltage VDD may be coupled to a terminal of a chip or integrated circuit comprising the bandgap circuit 100. Moreover, as outlined above, the NMOS transistors may equally well be replaced by NPN-bipolar transistors and the PMOS transistors by PNP-bipolar transistors.

As will be outlined in the following, the additional output stage 800 offers the possibility of very precise recognition of the equilibrium point of the differential amplifier 250.

While the above-described conditions 1 and 2 along with the respective circuits according to embodiments of the present invention mainly serve as a cause adjustment of the voltage regime, the circuit shown in FIG. 10 allows a far more precise recognition of the equilibrium point of the bandgap reference circuit 110 or of the equilibrium point of the differential amplifier 250. This precise recognition of the equilibrium point is achieved by the additional output stage 800 for the differential amplifier 250 located in the feedback path of the bandgap reference circuit 110. The additional output stage is formed by the transistors 960, 1010. The PMOS transistor 960 is controlled by the voltage present at the second internal node 850. Moreover, the PMOS transistor 960 is dimensioned smaller when compared to the PMOS transistors 810, 820 of the current mirror circuit.

As shown in FIG. 3, the voltages of the first and second nodes 180, 190 of the bandgap reference circuits 110 follow the supply voltage VDD. As long as the equilibrium point P1 (cf. FIGS. 2, 3, 4) is not reached, a small voltage difference exists between the two nodes 180, 190 of the two branches 140, 150 of the bandgap reference circuits 110. The voltage at the second node 190 is for smaller voltages than the equilibrium voltage corresponding to the equilibrium point P1, smaller than the voltage or potential of the first node 180 of a first branch 140. The previously described voltage difference appears amplified several times as a large voltage difference at the first and second internal nodes 840, 850 of the differential amplifier 250. Hence, under the circumstances described above, the potential of the second internal node 850 is smaller than that of the first internal node 840.

As a consequence, the third PMOS transistor 830 and the PMOS transistor 960 are (fully) turned on and the status signal bandgap_ok comprises a voltage of 0 V. Only when the equilibrium point of the differential amplifier 250 is reached, are the voltages at the first and second nodes 180, 190 of the two branches 140, 150 of the bandgap reference circuit 100, as well as the voltages of the first and second internal nodes 840, 850 of the differential amplifier 250 equal. In this situation, the first and second PMOS transistors 810, 820 carry the same amount of current. Due to the circuitry, through the third NMOS transistor 890 serving as the current source, the sum of the currents through the first and second PMOS transistors 810, 820 flows. The current source transistor (third NMOS transistor) 890 is (approximately) twice as large as the NMOS transistor 1010. Therefore, the current flow through the NMOS transistor 1010 is larger than through the PMOS transistor 960. As a consequence, the status signal or signal bandgap_ok is provided with a voltage level representing a high state at the output of the inverter 980.

The described dimensioning of the first PMOS transistor 810, the second PMOS transistor 820 and the PMOS transistor 960 may help to ensure the recognition of the switching point. Employing an embodiment according to the present invention as, for instance, shown in FIG. 10, may, under some circumstances, provide the advantage of using the already-present highly precise differential amplifier 250. Moreover, only a small number of additional components and, hence, a small chip area is required. The additional energy consumption or current consumption may, under some circumstances, be small. Moreover, employing embodiments according to the present invention may provide a surveillance of the actually used reference circuit and/or the reference voltage VREF. An additional implementation of an additional voltage monitor may, therefore, be avoided.

As outlined above, the described embodiments according to the present invention may be altered in a great variety of ways. Apart from the already-described interchanging of the transistors, the adaptations concerning the devices comprising diode-like current/voltage characteristics, differences concerning logic circuits and concerning the driver circuits may also be implemented. Under some circumstances, it may be useful to implement a non-inverting driver circuit. In other words, instead of an inverter, it may sometimes be useful to implement a driver circuit in which, compared to the circuit of the inverter 670 shown in FIG. 6, the NMOS transistor and the PMOS transistor are exchanged with respect to the order of their appearance in the series connection. Therefore, depending on implementational details, logic circuits as well as driver circuits may be implemented to decrease a rise time of a signal at an output of the corresponding circuit compared to a rise time of a signal present at the respective input. Naturally, other logic circuits or driver circuits may equally well be designed and implemented to decrease a fall time. Moreover, it may also be advisable to implement the respective circuits to implement the generation of a logic circuit comprising an abrupt change of a level of the signal compared to a change of the signal present at the respective input of the circuit.

As outlined above, the different embodiments according to the present invention in the form of the bandgap circuit itself, a starter circuit 500 and the monitoring circuit 600 may be implemented separately from one another or in the form of any combination. To illustrate this further, FIG. 11 shows a circuit diagram of a bandgap circuit 100 with a bandgap reference circuit 110 as described in the context of FIGS. 1, 5 and 10, a feedback circuit 120 based on a differential amplifier 250 as illustrated and described in the context of FIG. 10 and along with an output stage 800 as described in the context of FIG. 10. These three-mentioned circuits, the bandgap reference circuits 110, the feedback circuit 120 along with the differential amplifier 250 and the output stage 800 form the circuits as described in the context of FIG. 10. Therefore, for the sake of simplicity, reference is made to FIG. 10 and the corresponding parts of the description concerning the structure and the mode of operation of the respective circuit elements. Moreover, for the sake of simplicity, the reference signs have been limited to the necessary reference signs in order to not obscure the overall impression of FIG. 11.

As described in the context of FIG. 5, the bandgap reference circuit 110 is coupled to a starter circuit 500 as described in the context of FIG. 5. In other words, the starter circuit 500 as described in FIG. 5 can also be found in the embodiment shown in FIG. 11. To be more precise, as described in the context of FIG. 5, the first node of the bandgap reference circuit 110 may be coupled to the respective terminal for the power supply voltage for low voltages present at the corresponding terminal.

Moreover, the circuit diagram of FIG. 11 also shows the monitoring circuit 600 as described in the context of FIG. 6.

Each of the different (sub-) circuits, the starter circuit 500, the monitoring circuit 600 and the output stage 800 provide one status signal indicating the presence of the start-up ("start-up" signal), the presence of a minimum threshold for the supply voltage (VDDmin_ok) and a status signal indicative of reaching the equilibrium state of the differential amplifier 250 or that of the bandgap reference circuit 110, respectively. As a consequence, the bandgap circuit 100 shown in FIG. 11 further comprises an evaluation circuit 1100 comprising here three inputs 1100*a*, 1100*b* and 1100*c*. The output of the output stage 800 is coupled to the first input 1100*a*, so that the evaluation circuit 1100 is capable of receiving the corresponding "bandgap_ok" status signal. Accordingly, the second input 1100*b* is coupled to the output of the starter circuit 500, so that the evaluation circuit 1100 is capable of receiving the "start-up" status symbol. At the third input 1100*c*, the evaluation circuit 1100 is capable of receiving the status signal indicating the presence of a minimum supply voltage VDDmin_ok, since the respective input 1100*c* is coupled to the output of the monitoring circuit 600.

The evaluation circuit 1100 is adapted to provide an enabling signal at an output 1100*d* and to an optional terminal 1110 indicative of a situation in which a further circuit comprised in the integrated circuit or the chip in which the bandgap circuit 100 is integrated or a processor may be safely started. Internally, this may, for instance, be achieved by implementing an AND-gate 1120 into the evaluation circuit 1100 having three inputs, of which two are directly coupled to the first and third input 1100*a*, 1100*c*, since the corresponding status signals indicate, with a high signal, that the corresponding condition, which the respective circuit 800, 600 monitors, is met or fulfilled. However, since the status signal provided by the starter circuit 500 indicates, with a high level, the activation of the starter circuit, as an optional component, the evaluation circuit 1100 may further comprise an inverter 1130, which is coupled to the second input 1100*b* with an input, and to the AND-gate 1120 with its output in order to invert the corresponding status signal of the starter signal 500. Therefore, the evaluation circuit 1100 as described provides, at its terminal 1110, an enabling signal with a high level when all three conditions are met. If only one of these conditions is not met, the corresponding enabling signal will comprise a low level.

Embodiments according to the present invention may offer the possibility of verifying the previously outlined conditions in a form of a sequence of verifications, only providing the final enabling signal when all conditions are met. However, as indicated earlier, it is, by far, not required to implement all of the previously mentioned circuits, since for some applications and working parameters a verification of all conditions may simply be avoided for cost and implementation reasons. In principle, each of the additional circuits 500, 600, 800 may be implemented independently in the form of a sub-set of the previously mentioned circuits or, as shown in FIG. 11, simultaneously. Moreover, the surveillance circuit 130 shown in FIG. 1 may also additionally be implemented. Embodiments according to the present invention may therefore offer the possibility of implementing a circuit for a robust and reliable recognition of the correct functionality of a bandgap reference circuit.

Although the embodiments have, so far, been described in terms of a bandgap reference circuit for providing a 1.2 V reference voltage, other bandgap reference circuits may also be accordingly implemented. For instance, by integrating additional resistors in parallel to the two diodes 210, 240 of the bandgap reference circuit, higher reference voltages may also be obtainable. Naturally, by varying the material properties of the bandgap devices (i.e. the diodes 210, 240), an adaption of the reference voltage VREF may also be obtained.

Embodiments according to the present invention may be implemented in a wide range of applications. As outlined above, circuits relying on an absolute value of a reference voltage are frequently encountered. In principle, embodiments according to the present invention may therefore be implemented in all kinds of integrated circuits (IC) and chips comprising a bandgap reference circuit or employing same. One example is micro-controller Ics, CPUs (Central Processing Unit), GPUs (Graphical Processing Unit), SOCs (System on Chip), ASICs (Application Specific Integrated Circuits) and other integrated circuits.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concept disclosed herein and comprehended by the claims that follow.

The invention claimed is:

1. A starter circuit for a bandgap circuit, comprising:

the bandgap circuit comprising a bandgap reference circuit comprising a first branch and a second branch, the first branch comprising a first node, the second branch comprising a second node such that a potential at the first node is equal to a potential at the second node in an equilibrium of the bandgap reference circuit, the bandgap reference circuit further comprising a feedback node for a feedback signal, the feedback node being coupled to the first and the second branches; and a feedback circuit coupled to the first and the second nodes, the feedback circuit being adapted to compare the potentials of the first and the second nodes and adapted to provide a feedback signal to the feedback node based upon the comparison of the potentials of the first and the second nodes;

the starter circuit further comprising a driver circuit with an input and an output, the input being coupled to the feedback node of the feedback circuit; and a transistor directly coupled, with a first terminal, to a terminal for a supply voltage, the transistor being coupled, with a second terminal, to the first node of the bandgap reference circuit, and the transistor being coupled, with a control terminal, to the output of the driver circuit, wherein a status signal comprising an information indicating an activity of the starter circuit is obtainable;

an evaluation circuit adapted to receive the status signal from the output of the driver circuit, wherein the evaluation circuit is adapted to provide an enabling signal indicative of a situation to start a further circuit or a processor; and a monitoring circuit comprising a device having a diode-like current/voltage characteristic with respect to a threshold voltage;

wherein the device is a diode, or wherein the device is a bipolar transistor with a basis terminal coupled to a collector terminal or an emitter terminal of the bipolar transistor, or wherein the device is a field effect transistor with a gate terminal being coupled to a source terminal or a drain terminal of the field effect transistor, the device having a first terminal and a second terminal, the monitoring circuit further comprising a current source being directly coupled to the terminal for the supply voltage and the first terminal of the device, wherein the second terminal of the device is directly coupled to a terminal for a reference potential, and the monitoring circuit further comprising a logic circuit coupled, with an input, to the first terminal and comprising an output, at which a further status signal is obtainable, the further status signal comprising an information indicating the presence of a sufficient voltage level at the terminal for the supply voltage to operate the bandgap reference circuit and the feedback circuit in a closed feedback mode of operation, the logic circuit being adapted to generate the further status signal based on the potential present at the first terminal of the device, and wherein the evaluation circuit is adapted to provide the enabling signal also on the basis of the further status signal.

2. The starter circuit according to claim 1, wherein the transistor of a starter circuit is only coupled to the first node with its second terminal.

3. The starter circuit according to claim 1, wherein the transistor is, adapted such that the transistor decouples the first node of the bandgap reference circuit from the terminal for the supply voltage when a potential at the terminal for the supply voltage becomes larger than a predetermined potential.

4. The starter circuit according to claim 1, wherein the starter circuit is part of an integrated circuit and the terminal for the supply voltage is a terminal for the supply voltage of the integrated circuit.

5. The starter circuit according to claim 1, wherein the driver circuit is an inverter and the transistor is an n-channel field effect transistor or an npn-bipolar transistor.

6. The starter circuit according to claim 1, further comprising an evaluation circuit adapted to receive the status signal from the output of the driver circuit, wherein the evaluation circuit is adapted to provide an enabling signal indicative of a situation to start a further circuit or a processor.

7. A bandgap circuit, comprising:

a bandgap reference circuit comprising a first branch and a second branch, the first branch comprising a first node, the second branch comprising a second node such that a potential at the first node is equal to a potential at the second node in an equilibrium of the bandgap reference circuit, the bandgap reference circuit further comprising a feedback node for a feedback signal, the feedback node being coupled to the first and the second branches;

a feedback circuit coupled to the first and the second node, the feedback circuit being adapted to compare the potentials of the first and the second nodes and adapted to provide the feedback signal to the feedback node based upon the comparison of the potentials of the first and the second nodes, wherein the feedback circuit is further adapted to provide the feedback signal based on a control signal provided to a control terminal of a feedback transistor;

an output stage comprising a current source and an output stage transistor, the current source and the output stage transistor being directly connected in series between a terminal for a supply voltage and a terminal for a reference potential, the output stage transistor being coupled, with a control terminal, to the feedback circuit to receive the control signal, the output stage further comprising a logic circuit coupled, with an input, to a node between the output stage transistor and the current source of the output stage, the logic circuit further comprising an output, at which a status signal comprising an information indicative of the bandgap reference circuit reaching the equilibrium is obtainable.

8. The bandgap circuit according to claim 7, wherein the logic circuit is adapted to decrease a rise time at the output compared to a rise time of a corresponding signal at the input of the logic circuit.

9. The bandgap circuit according to claim 7, wherein the logic circuit is an inverter.

10. The bandgap circuit according to claim 7, wherein the output stage transistor is adapted such that a potential at the input of the logic circuit is such that, when the equilibrium of the bandgap reference circuit is reached, the logic circuit provides the status signal indicating the presence of the equilibrium, and wherein the transistor is adapted such that, when the equilibrium is not reached due to a potential at the terminal for the supply voltage being too small for reaching the equilibrium, the status signal does not indicate the presence of the equilibrium.

11. The bandgap circuit according to claim 7, wherein the feedback circuit comprises a differential amplifier for comparing potentials of the first and the second nodes, the differential amplifier comprising an internal current source providing an internal current, wherein the current source of the output stage is adapted to provide a current proportional to the internal current, wherein the differential amplifier further comprises at least one internal transistor such that the at least one internal transistor of the differential amplifier and the output stage transistor are directly coupled to the terminal of the supply voltage, and wherein the transistor of the output stage is adapted to transport a smaller current than the at least one internal transistor under the same operational parameters.

12. The bandgap circuit according to claim 7, wherein the bandgap circuit is part of an integrated circuit, the terminal for the supply voltage is a terminal for a supply voltage of the integrated circuit, and wherein the terminal for the reference potential is a terminal for a reference potential of the integrated circuit.

13. The bandgap circuit according to claim 7, wherein the transistor of the output stage is an n-channel field effect transistor or an npn-bipolar transistor.

14. The bandgap circuit according to claim 7, wherein the current source of the output stage is a transistor.

15. The bandgap circuit according to claim 7, further comprising an evaluation circuit coupled, with an input, to the output of the logic circuit, adapted to receive the status signal and adapted to provide an enabling signal indicative of a situation to start a further circuit or a processor.

16. The bandgap circuit according to claim 15, further comprising a monitoring circuit comprising a device having a diode-like current/voltage characteristic with respect to a threshold voltage;

wherein the device is a diode, or wherein the device is a bipolar transistor with a basis terminal coupled to a collector terminal or an emitter terminal of the bipolar transistor, or wherein the device is a field effect transistor with a gate terminal being coupled to a source terminal or a drain terminal of the field effect transistor, the device having a first terminal and a second terminal, the monitoring circuit further comprising a current source being directly coupled to the terminal for the supply voltage and the first terminal of the device, wherein the second terminal of the device is directly coupled to a terminal for a reference potential, and the monitoring circuit further comprising a logic circuit coupled, with an input, to the first terminal and comprising an output, at which a further status signal is obtainable, the further status signal comprising an information indicating the presence of a sufficient voltage level at the terminal for the supply voltage to operate the bandgap reference circuit and the feedback circuit in a closed feedback mode of operation, the logic circuit being adapted to generate the further status signal based on the potential present at the first terminal of the device, and wherein the evaluation circuit is adapted to provide the enabling signal also on the basis of the further status signal.

17. A monitoring circuit for a bandgap circuit, comprising:

a device having a current/voltage characteristic with a quasi-constant voltage drop for a plurality of current values above or below a threshold voltage, the device having a first terminal and a second terminal;

a current source being directly coupled to a terminal for a supply voltage and the first terminal of the device, wherein the second terminal of the device is directly coupled to a terminal for a reference potential;

a logic circuit coupled, with an input, to the first terminal of the device and comprising an output, at which a status signal is obtainable, the status signal comprising an information indicating the presence of a sufficient voltage level at the terminal for the supply voltage to operate the bandgap circuit in a closed feedback mode of operation, the logic circuit being adapted to generate the status signal based on the potential present at the first terminal of the device; and wherein the device is a diode with the first terminal of the device being an anode of the diode and the second terminal of the device being a cathode of the diode, or wherein the device is a bipolar transistor with a basis terminal coupled to a collector terminal or an emitter terminal of the bipolar transistor, or wherein the device is a field effect transistor with a gate terminal being coupled to a source terminal or a drain terminal of the field effect transistor.

18. The monitoring circuit according to claim 17, wherein the logic circuit is adapted to provide a logic signal based on a signal present at the input.

19. The monitoring circuit according to claim 17, wherein the logic circuit is an inverter or a complimentary metal oxide-semiconductor inverter (CMOS inverter).

20. The monitoring circuit according to claim 17, wherein the current source of the monitoring circuit is a transistor.

21. The monitoring circuit according to claim 17, wherein the bandgap circuit is part of an integrated circuit, the terminal for the supply voltage is a terminal for a supply voltage of the integrated circuit, and wherein the terminal for the reference potential is a terminal for a reference potential of the integrated circuit.

22. A bandgap circuit, comprising:

a bandgap reference circuit comprising a first branch and a second branch, the first branch comprising a first node, the second branch comprising a second node such that a potential at the first node is equal to a potential at the second node in an equilibrium of the bandgap reference circuit, the bandgap reference circuit further comprising a feedback node for a feedback signal, the feedback node being coupled to the first and the second branches;

a feedback circuit coupled to the first and the second nodes, the feedback circuit being adapted to compare the potentials of the first and the second nodes and adapted to provide a feedback signal to the feedback node based upon the comparison of the potentials of the first and the second nodes;

a driver circuit with an input and an output, the input being coupled to the feedback node of the feedback circuit, wherein a first status signal comprising an information indicating a presence of a situation in which the first node is coupled to the terminal for the supply voltage is obtainable at the output of the driver circuit;

a monitoring circuit comprising a device having a diode-like current/voltage characteristic with respect to a threshold voltage;

wherein the device is a diode, or wherein the device is a bipolar transistor with a basis terminal coupled to a collector terminal or an emitter terminal of the bipolar transistor, or wherein the device is a field effect transistor with a gate terminal being coupled to a source terminal or a drain terminal of the field effect transistor, the device having a first terminal and a second terminal, a current source being directly coupled to the terminal for the supply voltage and the first terminal of the device, wherein the second terminal of the device is directly coupled to a terminal for a reference potential, and a logic circuit coupled, with an input, to the first terminal of the device and comprising an output, at which a second status signal is obtainable, the second status signal comprising an information indicating the presence of a sufficient voltage level at the terminal for the supply voltage to operate the bandgap circuit in a closed feedback mode of operation, the logic circuit being adapted to generate the second status signal based on the potential present at the first terminal of the device;

an output stage comprising a current source and an output stage transistor, the current source and the output stage transistor being directly connected in series between the terminal for the supply voltage and the terminal for the reference potential, the output stage transistor being coupled, with a control terminal, to the feedback circuit to receive the control signal, the output stage further comprising a further logic circuit coupled, with an input, to a node between the output stage transistor and the current source of the output stage, the further logic circuit further comprising an output, at which a third status signal comprising an information indicative of the bandgap reference circuit reaching an equilibrium is obtainable; and an evaluation circuit adapted to receive the first, the second and the third status signals and to generate an enabling signal indicative of a situation to start a further circuit or a processor.

23. The bandgap circuit according to claim 22, wherein the bandgap circuit is part of an integrated circuit and the terminal for the power supply voltage is a terminal for a supply voltage of the integrated circuit and the terminal for the reference potential is a terminal for a reference potential of the integrated circuit.

* * * * *